US005390638A

United States Patent [19]

Hornby et al.

[11] Patent Number: 5,390,638

[45] Date of Patent: Feb. 21, 1995

[54] FUEL RAIL ASSEMBLY

[75] Inventors: Michael J. Hornby, Williamsburg; Gary D. Vattelana, Prince George, both of Va.

[73] Assignee: Siemens Automotive L.P., Auburn Hills, Mich.

[21] Appl. No.: 201,840

[22] Filed: Feb. 25, 1994

[51] Int. Cl.[6] ..... F02M 55/02

[52] U.S. Cl. ..... 123/456; 123/469; 285/305

[58] Field of Search ..... 123/456, 468, 469, 470; 285/188–189, 305, 403, 921, 314, 81; 138/109

[56] References Cited

U.S. PATENT DOCUMENTS

| | | | |
|---|---|---|---|
| 3,538,940 | 11/1970 | Graham | 285/305 |
| 3,753,582 | 8/1973 | Graham | 285/305 |
| 4,468,054 | 8/1984 | Orth | 285/189 |
| 4,846,506 | 7/1989 | Bocson et al. | 285/921 |
| 5,046,765 | 9/1991 | Usui | 285/305 |
| 5,062,405 | 11/1991 | Daly | 123/456 |
| 5,092,300 | 3/1992 | Imoehl et al. | 123/456 |
| 5,197,435 | 3/1993 | Mazur et al. | 123/468 |
| 5,352,586 | 10/1982 | Hayden | 285/305 |

*Primary Examiner*—Willis R. Wolfe
*Assistant Examiner*—Thomas N. Moulis
*Attorney, Agent, or Firm*—George L. Boller; Russel C. Wells

[57] ABSTRACT

A fuel rail assembly that possesses a number of novel features relating to joints for connecting metal tubes such as crossover, inlet, and return tubes, to main plastic fuel tubes; retainer clips for retaining various fuel handling components in sockets formed in the plastic fuel tubes, such as retaining a fuel pressure regulator in a plastic cup of a main plastic fuel tube; and the construction of various plastic sockets in a main plastic fuel tube, such as the cups for receiving the fuel injectors.

11 Claims, 11 Drawing Sheets

FUEL RAIL ASSEMBLY

FIELD OF THE INVENTION

This invention relates to a fuel rail assembly for an internal combustion engine.

BACKGROUND AND SUMMARY OF THE INVENTION

It is known to fabricate a fuel rail assembly for a V-type internal combustion engine from two injection-molded main fuel tubes, one for each bank of cylinders, and to convey fuel from one tube to the other through a formed metal crossover tube. Examples of fuel rails are shown in a number of commonly assigned patents. Various forms of retention clips, brackets, etc. are used to connect the various fuel handling components together in fluid-tight fashion. Typically O-ring seals are used to seal the connections.

External packaging constraints impose limitations on engine compartments of automotive vehicles, and they can impact the fuel rail assembly. For example the available vertical space may be limited, necessitating that the fuel rail assembly be as vertically compact as possible. Cost of fabrication is also a consideration, and it is important that a fuel rail assembly be designed for cost-effective fabrication.

The present invention relates to a fuel rail assembly that possesses a number of novel and advantageous features, including: joints for connecting tubes such as crossover, inlet, and return tubes, to the plastic fuel tubes; retainer clips for retaining various fuel handling components in sockets formed in the plastic fuel tubes, such as retaining a fuel pressure regulator in a plastic cup of a fuel tube; the construction of various plastic sockets in a fuel tube, such as the cups for receiving the fuel injectors. Other novel features will appear in the following detailed disclosure of a presently preferred embodiment.

The disclosure includes drawings that depict a presently preferred embodiment of the invention according to the best mode contemplated at this time for carrying out the invention.

DESCRIPTION OF THE PREFERRED EMBODIMENT

Figure 1:
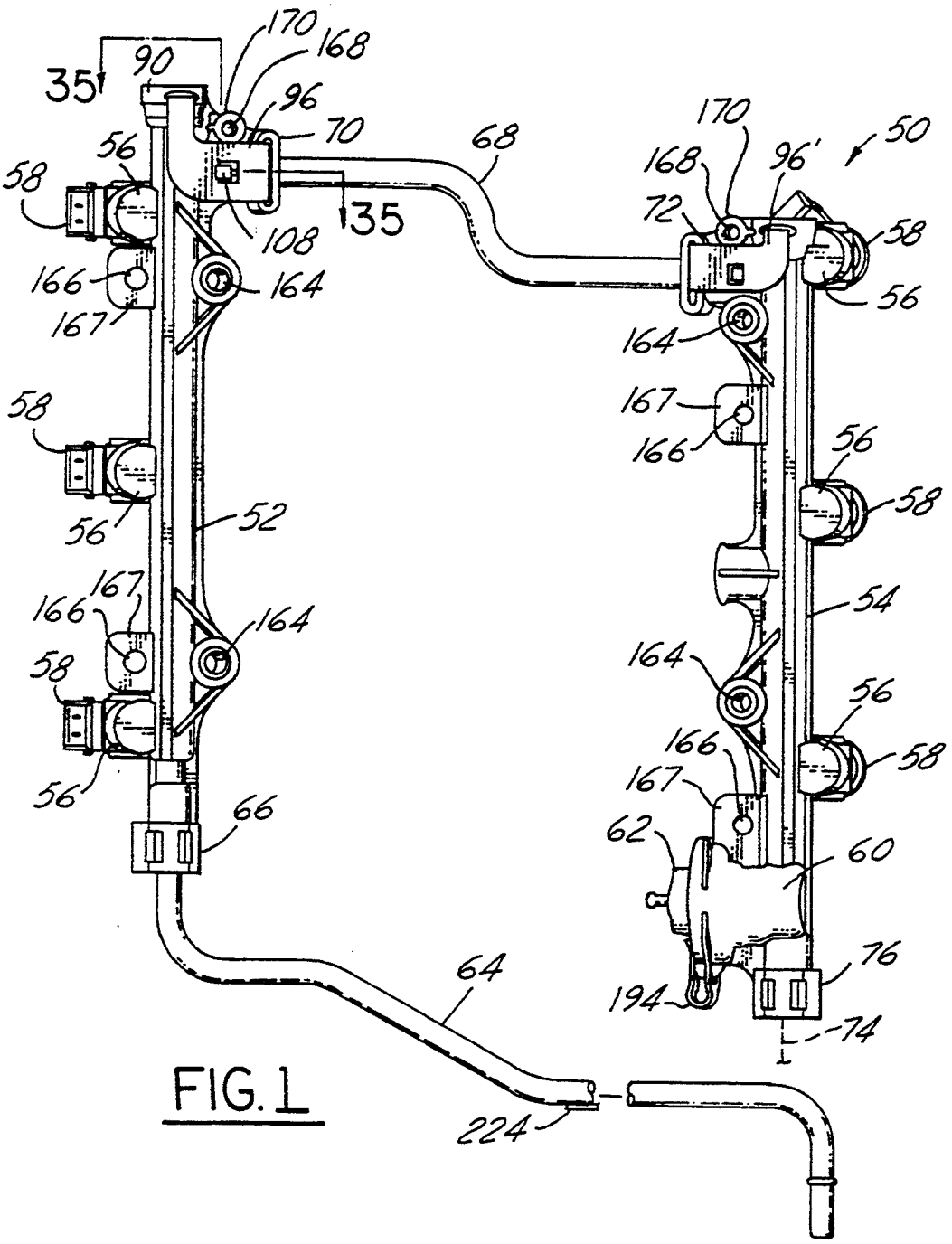
FIG. 1 is a top plan view of a fuel rail assembly embodying principles of the invention.
Figure 2:
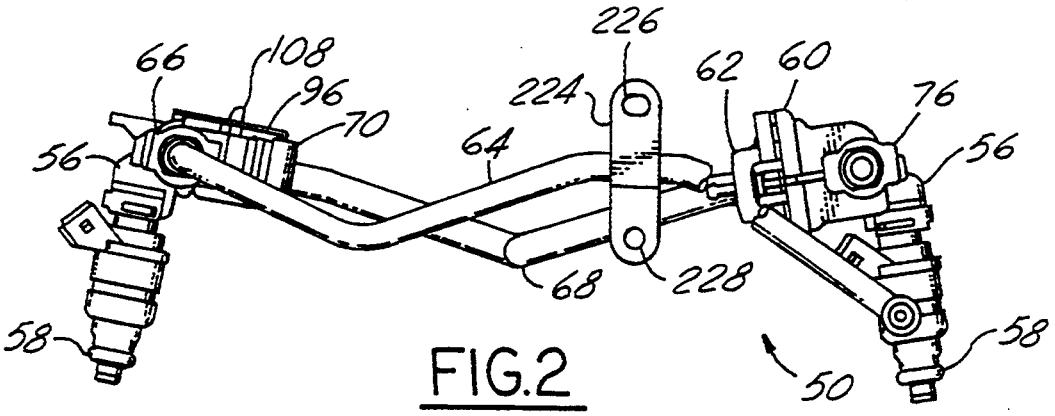
FIG. 2 is a front elevational view of FIG. 1.
Figure 3:
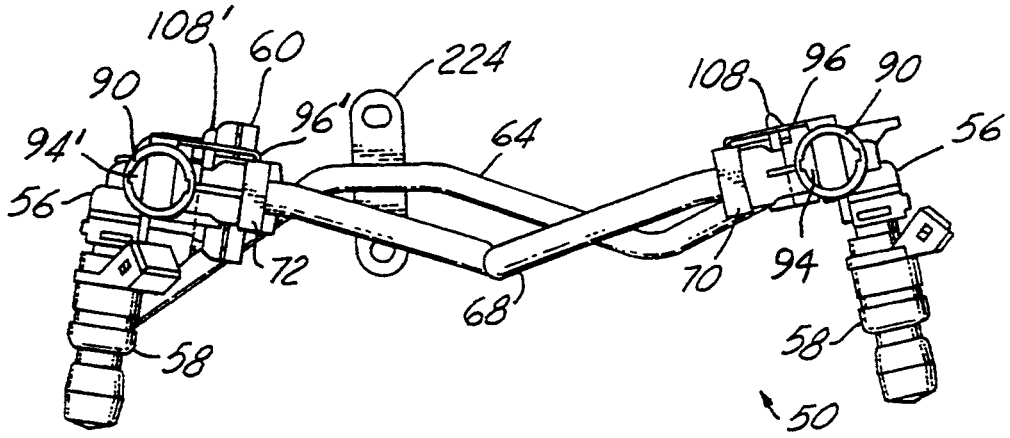
FIG. 3 is a rear elevational view of FIG. 1.

FIGS. 1–3 illustrate a fuel rail assembly 50 that is designed for use with a six-cylinder, V-type internal combustion engine. Fuel rail assembly 50 comprises a first main fuel tube 52 for serving a bank of three cylinders on one side of the engine and a second main fuel tube 54 for serving a bank of a like number of cylinders on the opposite side of the engine. (In FIGS. 1–3, these two fuel tubes are tipped slightly about their long dimensions from other drawing Figs. that show each one by itself.) Each main fuel tube 52, 54 is a plastic part that has been injection molded from a suitable material for use in handling pressurized liquid fuels such as gasoline, methanol, etc. Each main fuel tube further comprises a number of sockets for various purposes, including three integral sockets, or cups, 56 into each of which the top of a corresponding top-feed, solenoid-operated fuel injector 58 is inserted and retained in a secure, sealed manner. Main fuel tube 54 further comprises an integral socket, or cup, 60 into which a conventional fuel pressure regulator 62 is inserted and retained in a secure, sealed manner.

Figure 17:
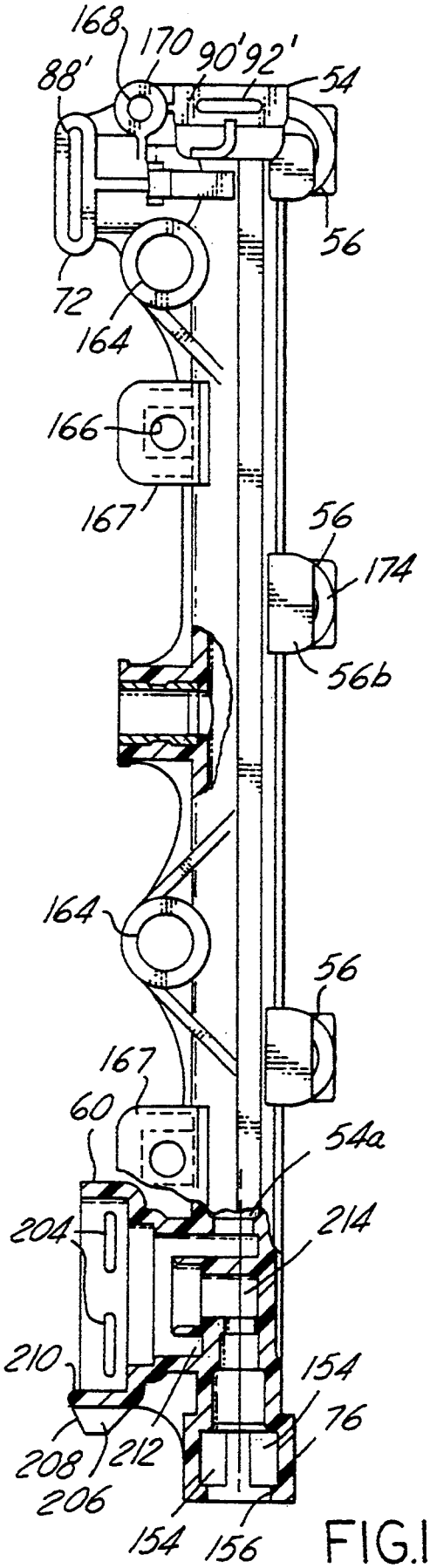
FIG. 17 is an enlarged top plan view of one of the two main fuel tubes of the assembly of FIG. 1, with certain portions sectioned away for illustrative purposes.
Figure 18:
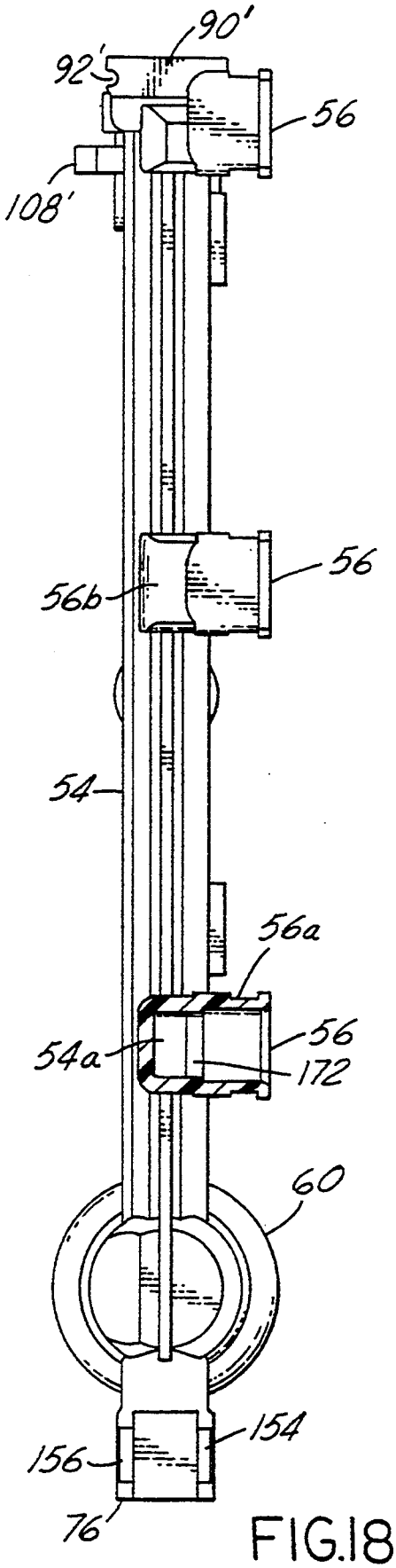
FIG. 18 is a right side view of FIG. 17.
Figure 19:
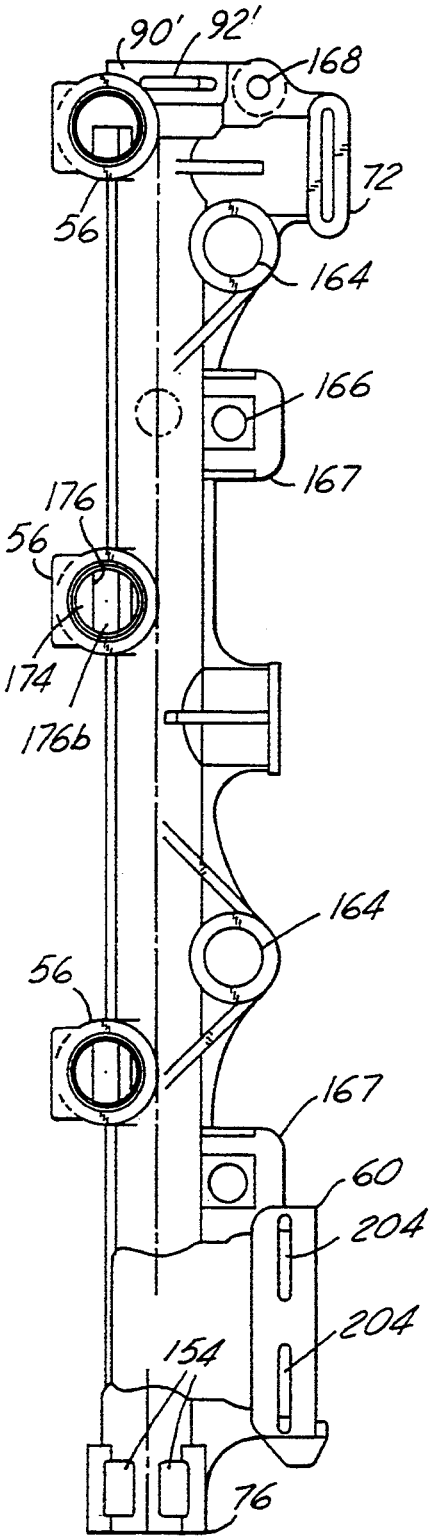
FIG. 19 is a bottom view of FIG. 17.
Figure 20:
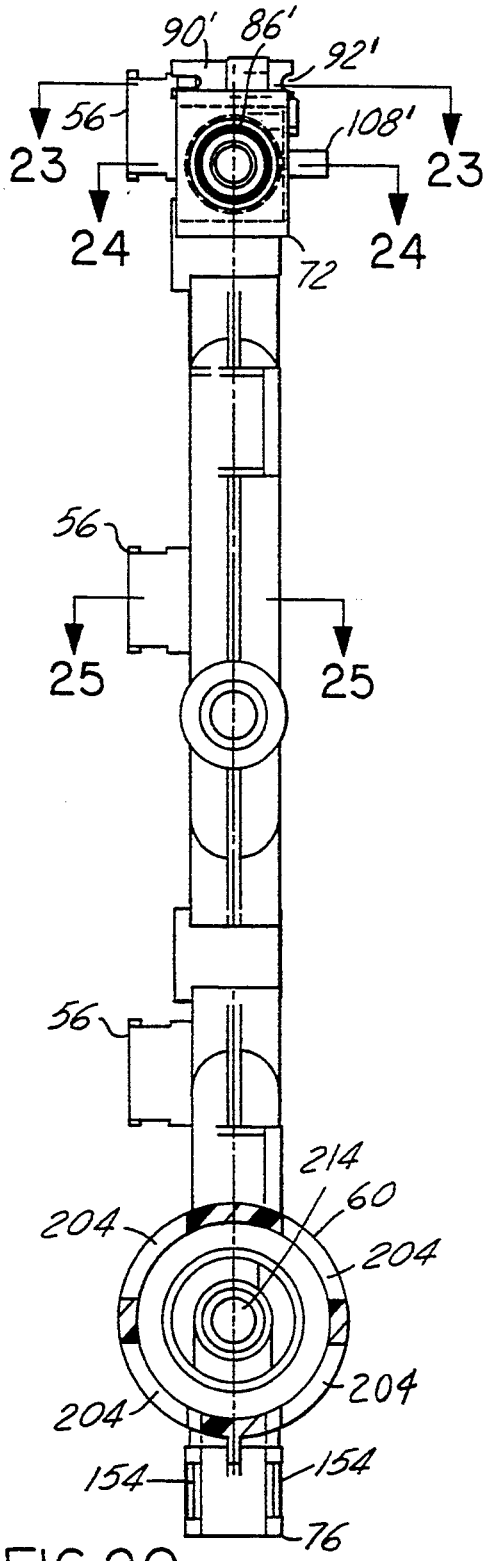
FIG. 20 is a left side view of FIG. 17 with a portion shown in cross-section for illustrative purposes.
Figure 21:
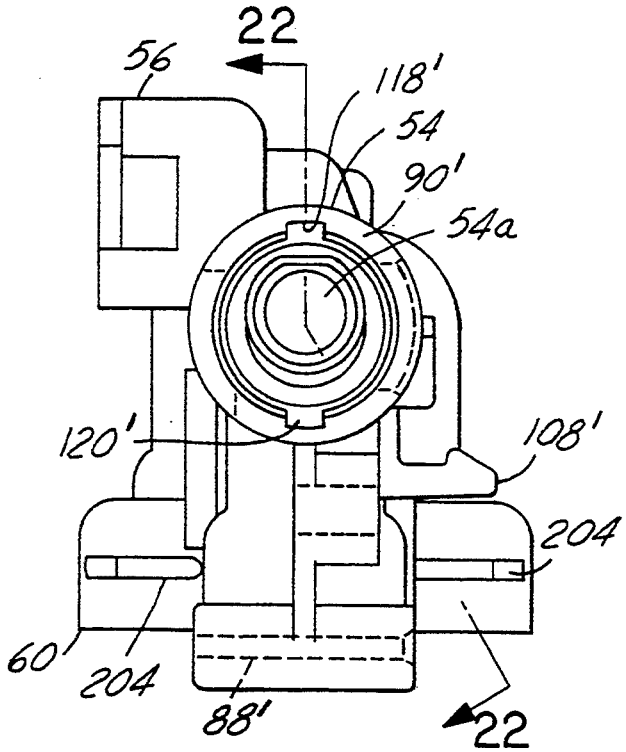
FIG. 21 is a top view, on an enlarged scale, of FIG. 20.
Figure 22:
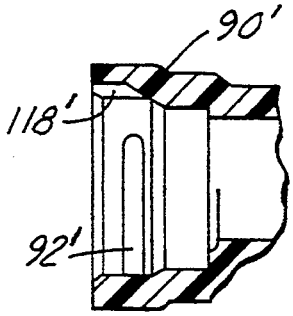
FIG. 22 is a fragmentary cross-sectional view taken in the direction of arrows 22—22 in FIG. 21.
Figure 23:
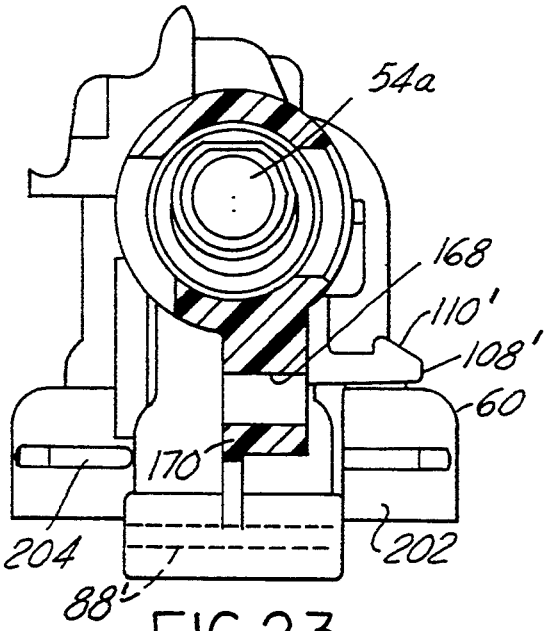
FIG. 23 is a transverse cross-sectional view, on an enlarged scale, taken substantially in the direction of arrows 23—23 in FIG. 20.
Figure 24:
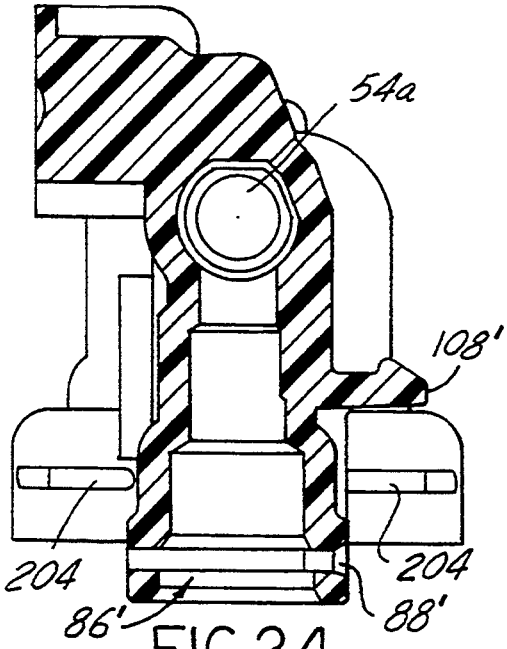
FIG. 24 is a transverse cross-sectional view, on an enlarged scale, taken in the direction of arrows 24—24 in FIG. 20.
Figure 27:
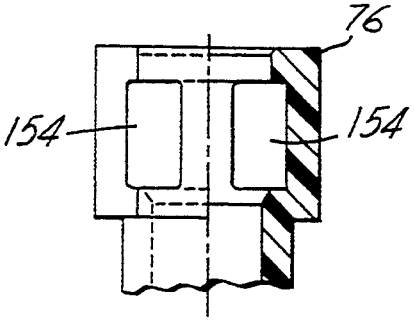
FIG. 27 is a cross-sectional view taken in the direction of arrows 27—27 in FIG. 26.
Figure 32:
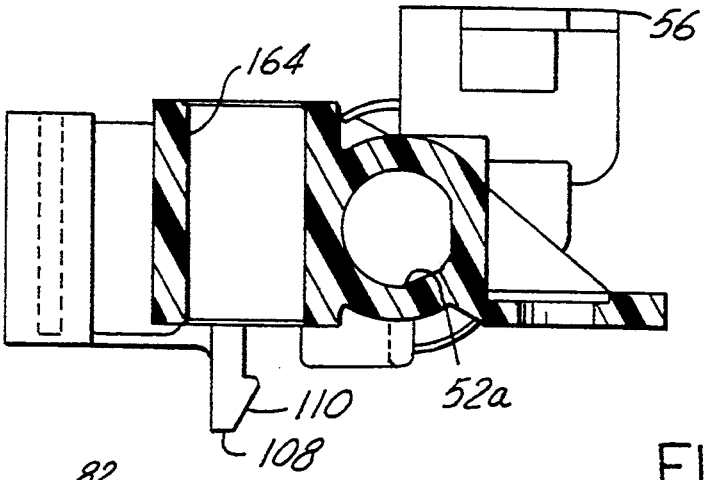
FIG. 32 is a transverse cross-sectional view, on an enlarged scale, taken in the direction of arrows 32—32 in FIG. 31.

Fuel delivered from a remote pump (not shown) to fuel rail assembly 50 enters through a fuel inlet tube 64 having one end inserted and retained in a secure, sealed manner in a socket 66 at one end of main fuel tube 52. Tube 52 comprises a main internal fuel passageway (reference 52*a* in FIG. 32) that serves liquid fuel to all three of its fuel injectors 58. The liquid fuel is delivered to the other main fuel tube 54 through a crossover fuel tube 68 that has one end inserted and retained in a secure, sealed manner in a socket 70 proximate the end of main fuel tube 52 that is opposite the end having socket 66. Tube 68 has another end inserted and retained in a secure, sealed manner in a socket 72 of tube 54. Socket 72 is generally across from socket 70, although it can be readily seen in FIG. 1 that tube 54 is slightly offset in the lengthwise direction relative to tube 52. In this regard, crossover tube 68 contains a suitable bend to provide for this offset. Tube 54 comprises a main fuel passage (reference 54*a* in FIGS. 17 and 25) that serves its three fuel injectors 58 and ends at fuel pressure regulator 62. Excess fuel that is relieved by pressure regulator 62 returns to tank (not shown) via a return tube 74 that is shown only schematically in FIG. 1 but has a connection with a socket 76 at the end of tube 54 proximate cup 60 by means of the same type of connection that connects tube 64 to socket 66.

In the operative system, when the pump is delivering fuel to fuel rail assembly 50, pressure regulator 62 regulates the pressure of the fuel delivered to fuel injectors 58 so that a substantially constant pressure differential is maintained between the fuel in the fuel rail assembly and the vacuum in the engine induction system where the nozzle ends of the fuel injectors are disposed. Having described the general organization and arrangement of fuel rail assembly 50, we may now direct attention to the specific details relating to the various inventive features.

Figure 34:
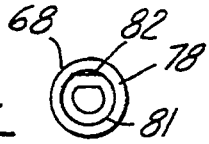
FIG. 34 is an axial end view of one end of the tube of FIG. 33.
Figure 33:
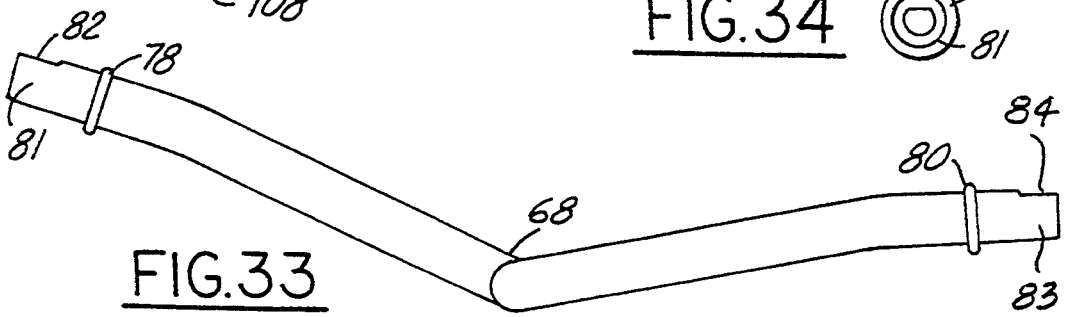
FIG. 33 is a front elevational view, on an enlarged scale, of a crossover tube of the assembly of FIG. 1.

A first inventive feature relates to the joints for connecting the ends of crossover tube 68 to the respective main fuel tubes 52, 54. Crossover tube 68 is shown in FIGS. 33 and 34 to comprise a length of cylindrical walled tubing that is formed to the desired shape including the formation of circular flanges 78 and 80 proximate each end. A further feature is that each terminal end portion 81, 83 is formed to a non-circular shape that is circular except for a flat 82, 84 respectively, that subtends an acute angle about the axis of the tube. The tube is formed with a symmetrical shape so that either terminal end portion can be inserted into either main fuel tube.

Figure 30:
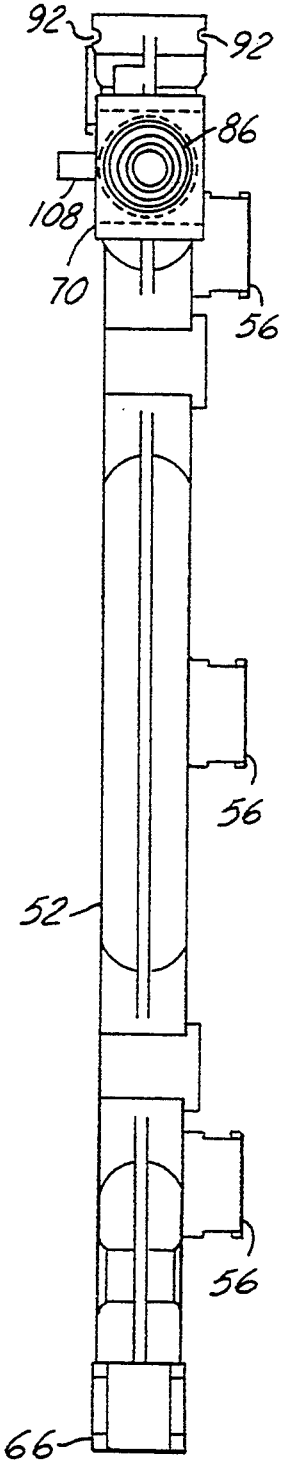
FIG. 30 is a right side view of FIG. 29.
Figure 31:
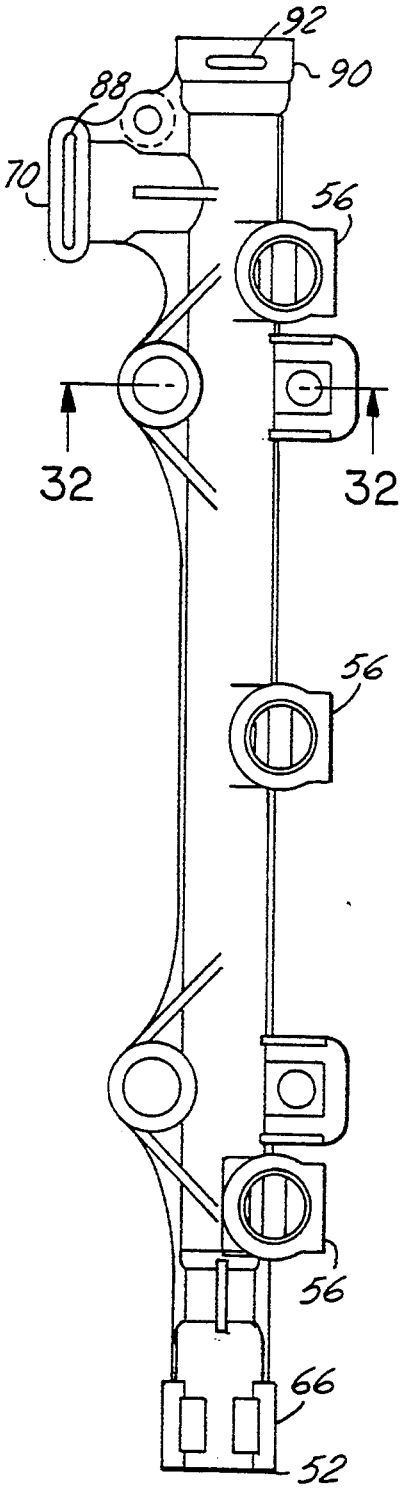
FIG. 31 is a bottom view of FIG. 29.
Figure 35:
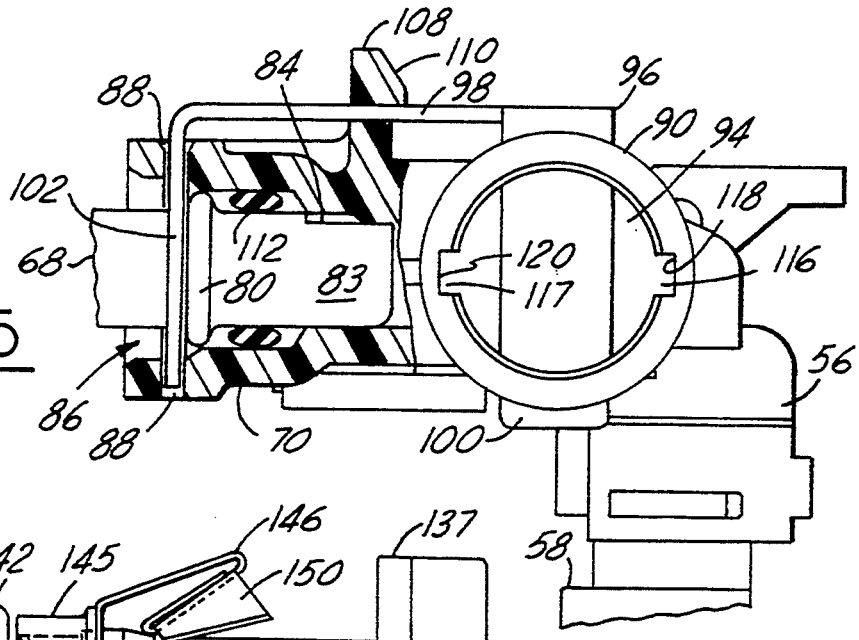
FIG. 35 is an enlarged fragmentary cross-sectional view taken generally in the direction of arrows 35—35 in FIG. 1.

FIG. 35 shows detail of socket 70 that is also representative of detail of socket 72, although such detail of the latter socket is not expressly shown by a similar Fig. Socket 70 comprises a stepped bore 86 that is transverse to the length of tube 52, being exactly perpendicular in this instance. At the entrance of stepped bore 86, the wall of socket 70 has a somewhat rectangular shape as viewed in FIG. 30. It also has sufficient thickness in the axial direction of bore 86 to provide for the incorporation of a vertical through-slot 88 that perpendicularly intersects the bore, passing through opposite top and bottom portions of the socket wall. The intermediate adjacent end of tube 52 comprises a circular socket 90. The marginal rim of socket 90 has a sufficient axial dimension to provide for the incorporation of a vertical through-slot 92 that passes through diametrically opposite top and bottom portions of the socket wall. Socket 90 is closed in fluid-tight fashion by means of a closure plug 94, details of which appear in FIGS. 13–16. Plug 94 is inserted into socket 90 to an extent sufficient for the plug to present no interference in the direction of through-slot 92.

Figure 10:
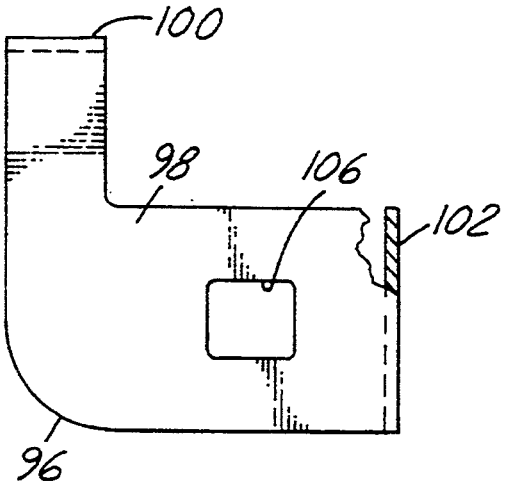
FIG. 10 is a top plan view, on an enlarged scale, of another bracket used in the fuel rail assembly of FIG. 1.
Figure 11:
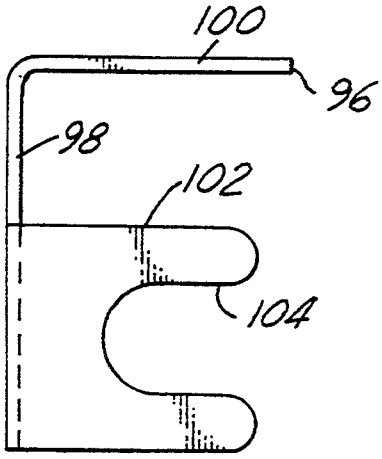
FIG. 11 is a right side view of FIG. 10.
Figure 12:
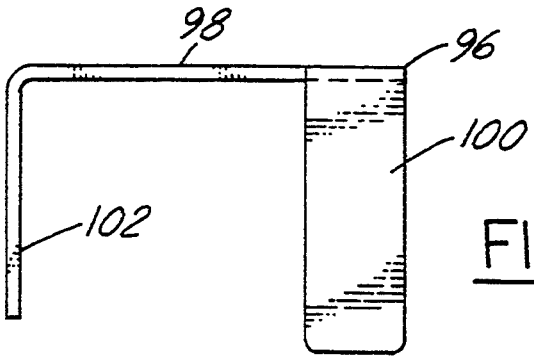
FIG. 12 is a rear elevational view of FIG. 10.
Figure 13:
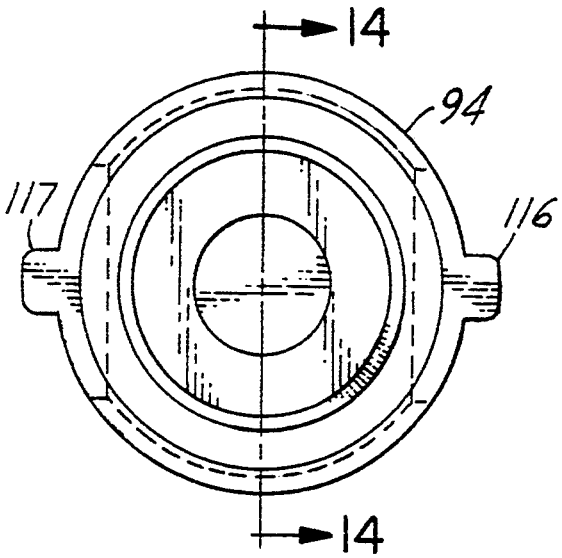
FIG. 13 is an axial end view, on an enlarged scale, of a plug that is used in the fuel rail assembly of FIG. 1.
Figure 14:
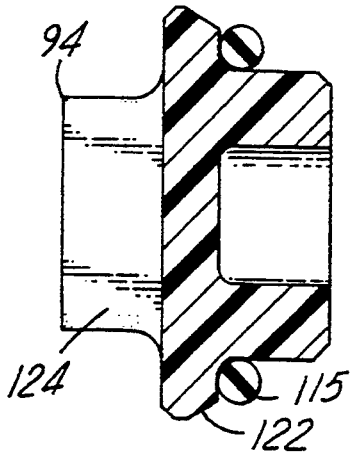
FIG. 14 is a cross-sectional view taken in the direction of arrows 14—14 in FIG. 13.
Figure 15:
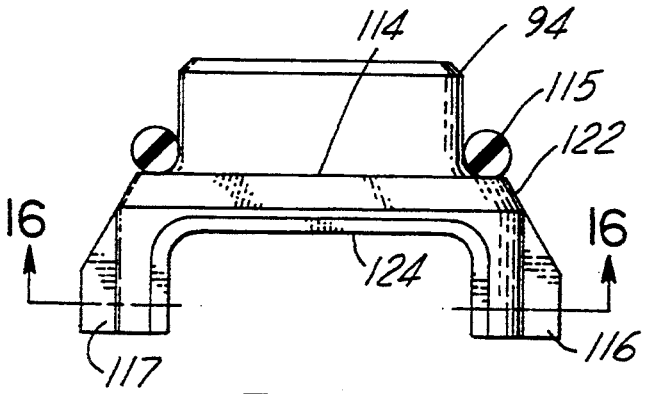
FIG. 15 is a top plan view of FIG. 13.
Figure 16:
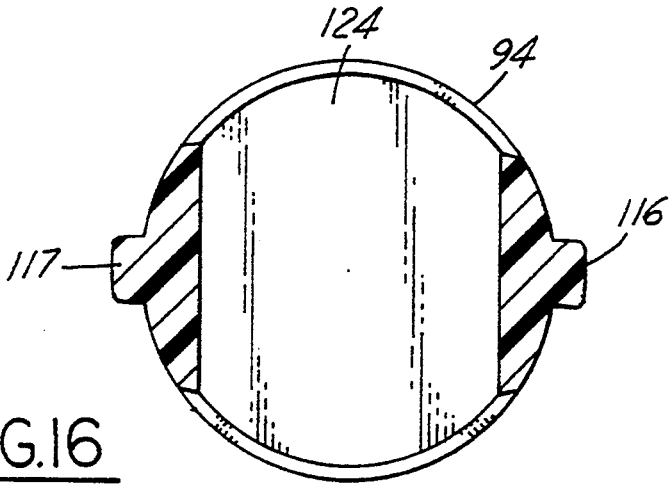
FIG. 16 is a cross-sectional view taken in the direction of arrows 16—16 in FIG. 15.

Socket 70 is sufficiently deep to allow an end (83, for instance) of crossover tube 68 to be inserted far enough to assure that the proximate flange 80 is disposed interiorly of the socket relative to through-slot 88. It is this condition that is portrayed in FIG. 35. Plug 94 and crossover tube 68 are retained in this relationship by means of a formed metal bracket 96 that is shown by itself in detail in FIGS. 10–12.

Bracket 96 is shaped with a generally planar intermediate portion 98 that is between end portions 100, 102. Intermediate portion 98, in plan, has an angled shape corresponding to the angle of the crossover tube to the main fuel tube, 90° in this instance. End portion 100 depends vertically from one end of intermediate portion 98 while end portion 102 depends vertically from the opposite end of intermediate portion 98. End portion 100 has the shape of an elongated rectangular tongue while end portion 102 comprises a slot 104 that endows its distal end with a fork shape. Intermediate portion 98 is also provided with a small rectangular-shaped through-hole 106.

FIG. 35 shows bracket 96 having been assembled to fuel rail assembly 50 to retain crossover tube 68 and plug 94 in place. Assembly of the bracket is accomplished by disposing it over tube 52 with the respective end portions 100, 102 aligned with the respective through-slots 92, 88, and then bodily displacing the bracket downwardly so that the two end portions enter their respective through-slots. Tube 52 is provided with an integral upstanding catch 108 that has an inclined surface 110 designed to be engaged by an edge of hole 106 as bracket 96 approaches the fully installed position shown by FIG. 35. Upon such engagement, the continued downward forceful displacement of bracket 96 causes catch 108 to be flexed out of the way allowing the bracket to continue its downward displacement toward its final position. The fit of the bracket's end portions 100, 102 in the respective through-slots 92, 98 constrains the bracket against any substantial displacement except in the vertical direction. Accordingly, when the bracket has been displaced downwardly sufficiently to cause the edge of hole 106 to move off surface 110, catch 108 snaps back to the position illustrated in FIG. 35 to present an interference with the marginal edge of hole 106 that prevents the bracket from being moved vertically upwardly. This completes the installation process.

Figure 38:
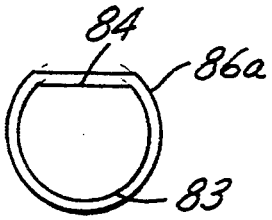
FIG. 38 is a somewhat schematic depiction of a relationship of the crossover tube of FIGS. 33 and 34 to a socket into which it is inserted.

It can be further seen in FIG. 35 that flange 80 has been captured by the forked distal end of end portion 102 while end portion 100 presents an obstruction that prevents removal of plug 94. An O-ring seal 112 that was disposed over the end of the crossover tube before its insertion into socket 70 is captured between flange 80 and an internal shoulder of bore 86. The shape of both crossover tube 68 and bore 86 is circular in this region where O-ring seal 112 is disposed. More interiorly, the non-circular terminal end portion of the crossover tube is received in a non-circular portion of bore 86 which has a shape generally corresponding to that of the terminal end portion of the crossover tube containing flat 84 but allowing a limited amount of relative circumferential positioning of the crossover tube within the socket, for example about 20°. Moreover, the relative axial dimensions are such that the captured crossover tube can move a limited axial amount relative to socket 70 while retaining the constraint on the amount of limited circumferential positioning between the two. This type of joint between crossover and main tubes is especially advantageous for the purpose of facilitating installation of fuel rail assembly 50 on an engine. FIG. 38 schematically presents the construction that allows the limited circumferential positioning of the tube within the socket, the non-circular portion of the socket being designated 86*a*.

It is to be observed that the axial dimension of socket 90 is relatively small because of externally imposed packaging constraints. This can give rise to difficulty in the inserting of closure plug 94. The particular design of plug 94 is intended to avoid this difficulty. Plug 94 comprises a shoulder 114 onto which is disposed an O-ring seal 115. When the plug is inserted into socket 90, it is confined by shoulder 114 to provide a fluid-tight seal with the wall of the fuel tube. Toward its exterior face, plug 94 is provided with two axially extending, radially projecting ribs 116, 117 on opposite diametrical sides. As can be seen in FIG. 35, the marginal rim of socket 90 is provided with respective slots 118, 120 for receiving the respective ribs 116, 117 when the plug is closing the socket. The leading edge has a chamfer 122 to facilitate the insertion process and when the plug has been inserted to the appropriate depth, a large vertical slot 124 that is present in the exterior face of the plug provides a clearance that allows end portion 100 of bracket 96 to pass completely through as seen in FIG. 35.

Figure 4:
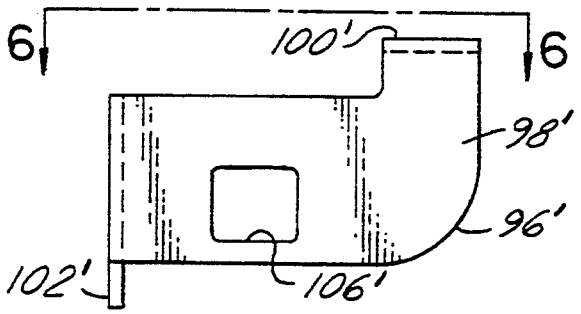
FIG. 4 is a top plan view, on an enlarged scale, of one bracket used in the fuel rail assembly of FIG. 1.
Figure 5:
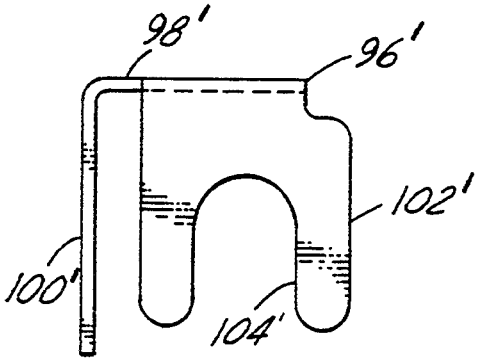
FIG. 5 is a left side elevational view of FIG. 4.
Figure 6:
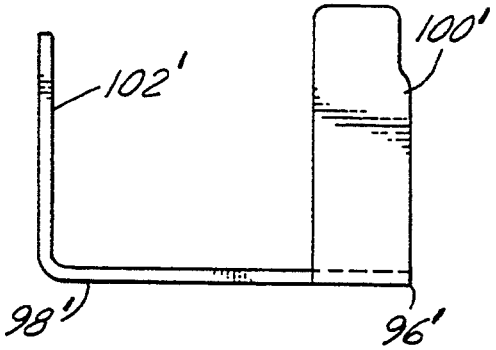
FIG. 6 is a view in the direction of arrows 6—6 in FIG. 4.

A similar type of joint connects the other end of crossover tube 68 to fuel tube 54. While the general principles of the joint are the same, the bracket that is used for this particular joint has a slightly different shape, and it is portrayed by itself in FIGS. 4–6 where its various features are identified by primed versions of the corresponding reference numerals used for bracket 96. Other corresponding parts of fuel tube 54 and its end closure plug are also identified by primed versions of the corresponding reference numerals used for the same parts of fuel tube 52 and for closure plug 94.

A second inventive feature relates to the joints for connecting the respective fuel inlet and return tubes 64 and 74 to sockets 66 and 76. The end of each tube 64 and 74 that connects to these two sockets comprises a circular cylindrical wall having a circular flange around the outside, like flanges 78, 80 of crossover tube 68. The act of simply pushing the end of each tube 64, 74 into the corresponding socket 66, 76 produces a secure, fluid-tight joint because a quick-connect type connector arrangement is employed. While a portion of that arrangement utilizes a known metal connector, the means for accommodating that existing connector involves a novel integration directly into the fuel tube.

Figure 36:
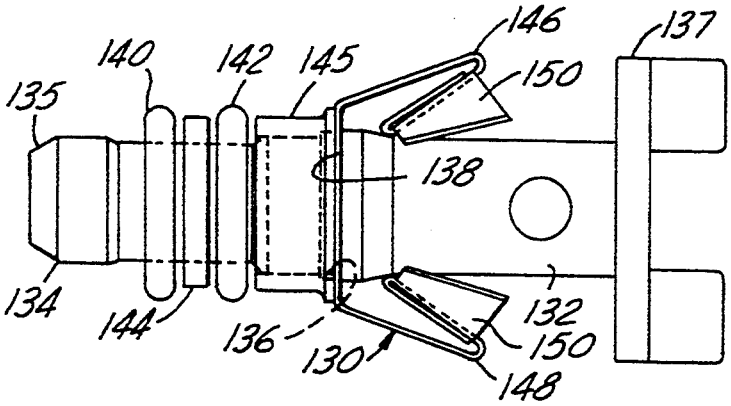
FIG. 36 illustrates a metal quick-connect retainer and an installation tool used for installing the metal quick-connect retainer in an end of a main fuel tube.

FIG. 36 shows the known metal connector 130 disposed on an intermediate portion of a shaft 132 of an installation tool 134. Tool 134 comprises a distal end 135 that is inserted through a circular flanged hole 136 at the center of connector 130 until a shoulder 138 on shaft 134 abuts the margin of hole 136 that faces a handle 137 at the proximal end of tool 134. Two O-rings seals 140, 142 that are separated by a spacer 144 are then placed on distal end 135. An annular retainer 145 is between seal 142 and connector 130. Connector 130 comprises two formed catches 146, 148 each of which flares generally radially outwardly from the outer margin of hole 136 in the proximal direction along shaft 132 and is then bent into a hair pin turn so as to converge back toward shaft 132. The side edges of the convergent portions of the catches include formed barbs 150. There are a total of four such barbs 150.

Figure 37:
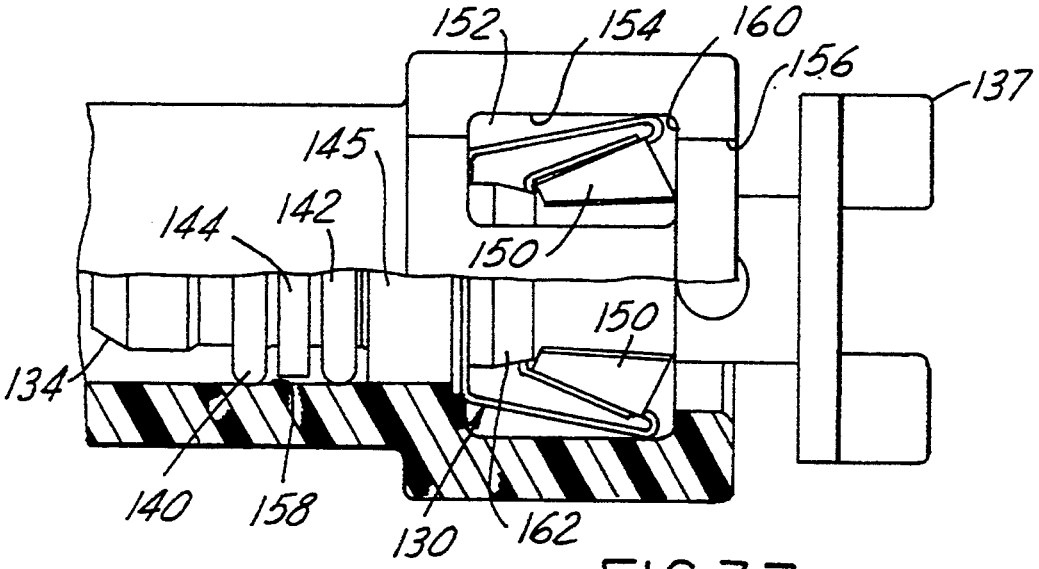
FIG. 37 is a view of an end portion of a main fuel tube, partly in section, showing the retainer of FIG. 36 being installed by the installation tool.

The side wall of each socket 66, 76 is radially enlarged to form a space 152 (FIG. 37) within which the corresponding connector can lodge when installed by use of tool 134. For accommodating the barbs 150, the radially enlarged side wall of the socket comprises four generally rectangular windows 154. Installation is performed by taking the assemblage shown in FIG. 36 and inserting distal end 135 of shaft 132 into the open end 156 of the socket. The insertion continues until seals 140, 142 and spacer 144 have been placed in a circular interior portion 158 of a fuel passage of the respective tube 52, 54, plug 145 has been inserted into the end of portion 158, and connector 130 has been placed in space 152. In the free condition of connector 130 shown in FIG. 36, the radially outermost portions of the catches lie on a circle that is larger than the opening at 156, and so they will be forced to resiliently contract as the connector is being inserted until they reach space 152 at which time they can return toward their free condition, causing barbs 150 to lodge in windows 154 in the process and the hair-pin ends to be in interference with an internal shoulder 160 proximate open end 156. Tool 134 is now extracted leaving the connector, seals, annular plug and spacer behind in the fuel tube. Note that shaft 132 has a tapered shoulder 162 that slightly flexes the catches to allow tool extraction.

When a fuel tube is now pushed into a socket 66, 76, its end portion passes through the installed pads 130, 145, 142, 144, 140, forming a fluid-tight seal, and its circular flange will lodge beyond the inwardly convergent portions of the two catches to prevent tube extraction. If it should become necessary to disconnect a fuel tube from a socket, a known extraction tool can be used.

It is to be noted that the windows 154 bear a particular relationship in each fuel tube 52, 54. Specifically, they are circumferentially oriented in the same line of mold draw as a number of other features, including slots, 88, 92 and sockets 56. This makes the molding of the fuel tubes less complex by avoiding the need to use cam- or slide-operated mold pins for creating the windows. Additional features of each fuel tube 52, 54 that are arranged for creation in the same line of draw as sockets 56, slots 88,92, and windows 154 are: mounting holes 164 through which fasteners (not shown) are passed to attach the fuel rail assembly to an engine, holes 166 in tabs 167 that are used to mount wiring harnesses for the fuel injectors on the fuel rail assembly, and holes 168 in bosses 170 adjacent sockets 70 and 90 in fuel tube 52 and sockets 72 and 90' in fuel tube 54 that provide portions of another means for fastening brackets 96, 96' to their respective fuel tubes, as will be explained later on. Holes 164 may be lined with metal insert sleeves that react the tension created in the fasteners that pass through them so that the fastener tension is maintained by such sleeves.

Figure 25:
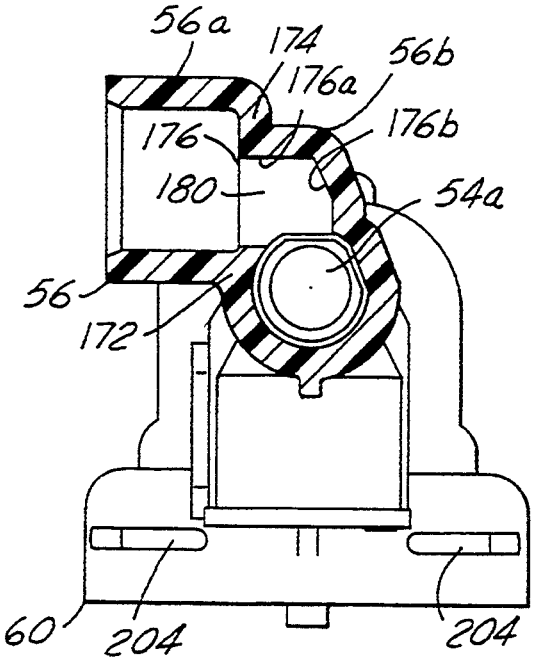
FIG. 25 is a transverse cross-sectional view, on an enlarged scale, taken in the direction of arrows 25—25 in FIG. 20.
Figure 26:
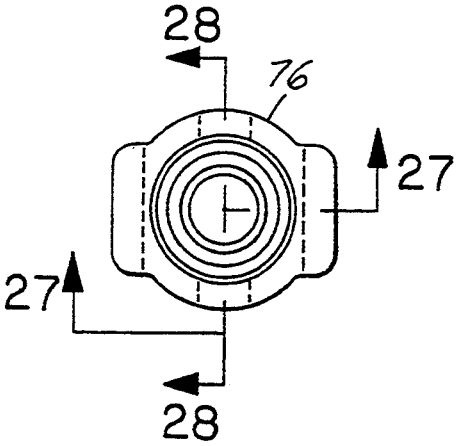
FIG. 26 is a bottom view, on an enlarged scale, of FIG. 20.
Figure 28:
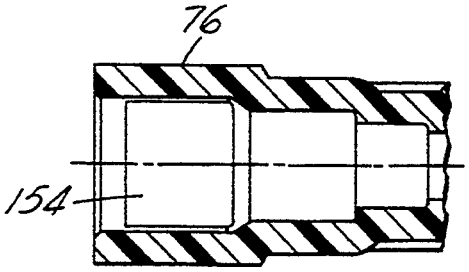
FIG. 28 is a cross-sectional view taken in the direction of arrows 28—28 in FIG. 26.
Figure 29:
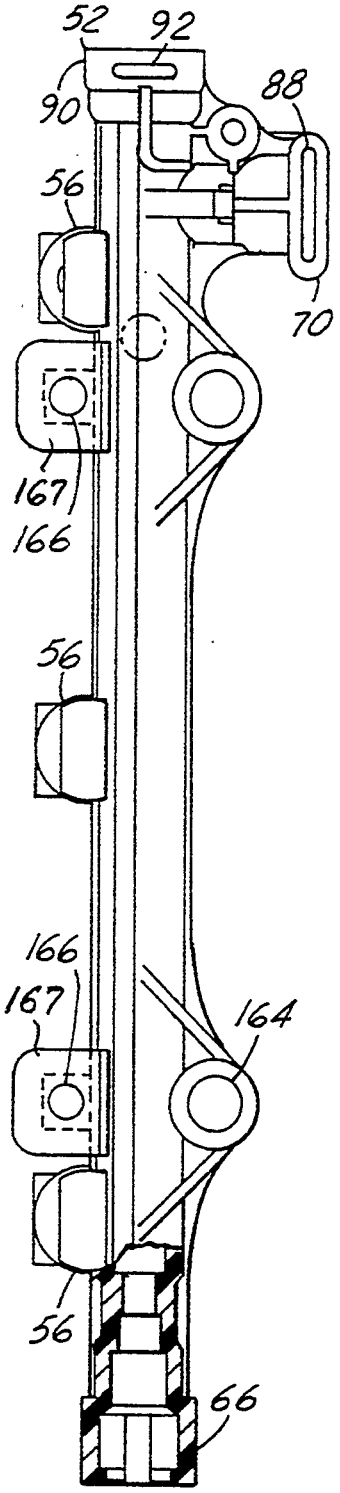
FIG. 29 is a top plan view, on an enlarged scale and partly in section, of the other main fuel tube of the assembly of FIG. 1.

A third inventive feature relates to the integral molding of the fuel injector sockets 56 with each fuel tube 52, 54. While molding of injector-receiving sockets integral with a fuel tube is of course already known, the particular organization and arrangement of sockets 56 with fuel tubes 52, 54, as exemplified by FIG. 25, is believed novel. Tubes, 52, 54 possess a low vertical profile in which each socket 56 is disposed at a side of the tube and extends downwardly therefrom so that no part of the socket protrudes above the tube. The downwardly open bottom portion 56*a* of each socket has a circular I.D., and while that bottom portion is generally circular walled, the outside of its rim is non-circular in shape for locating a clip (not shown) that is used to attach the corresponding fuel injector to the socket in a particular orientation. A portion of the top of bottom portion 56*a* merges with the tube wall in the location called out by the reference numeral 172, and in a location lying diametrically opposite 172, there is a partial transverse wall 174 across the top of bottom portion 56*a*. This leaves an opening 176 at the top of bottom portion 56*a* which has the shape of a truncated circle in all sockets 56 except the one that is proximate bracket 96' where the socket 56 overlaps the plug 94' inserted into socket 90' such that a portion (about half) of the truncated circular opening is occluded by wall surface of the tube needed for sealing of the plug to it. A top portion 56*b* of each socket encloses a short passage 180 extending from the side of the fuel tube to the top of bottom portion 56*a*. The entrance of this shod passage is at the side of the fuel tube and its exit is the truncated circular opening 176. The short passage has a distinctive surface 176*a* that is substantially flat and parallel to both the length of the fuel tube and the axis of the socket 56. Surface 176*a* is slightly elongated in the direction parallel with the length of the fuel tube. The short passage has a further distinctive surface 176*b* that extends from the upper edge of surface 176*a* to the fuel tube wall. It is generally flat and parallel to the length of the fuel tube, but it is inclined relative to surface 176*a*.

Figure 9:
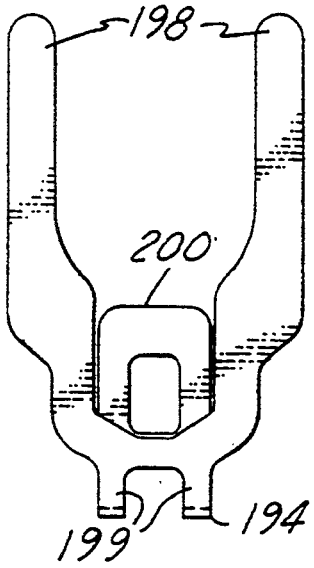
FIG. 9 is a bottom plan view of FIG. 7.
Figure 8:
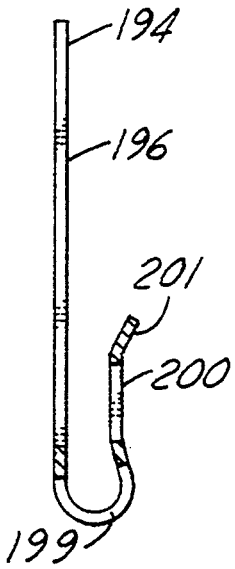
FIG. 8 is a cross-sectional view taken in the direction of arrows 8—8 in FIG. 7.
Figure 7:
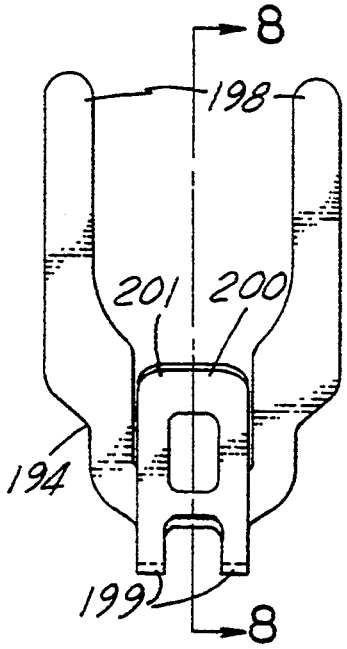
FIG. 7 is a top plan view, on an enlarged scale, of a retention clip that is used in the fuel rail assembly of FIG. 1.

A fourth inventive feature relates to cup 60 and to the mounting and retention of fuel pressure regulator 62 therein. Fuel pressure regulator 62 is conventional, and examples are shown in U.S. Pat. Nos. 5,105,787 and 5,146,896, commonly assigned. While the latter shows a retention clip and mounting that have some similarities to the retention clip and mounting that are used in the present invention, the present invention is distinguished by the manner in which the retention clip is attached. FIG. 1 above shows a retention clip 194 installed in fuel rail assembly 50, and details of the clip appear in FIGS. 7–9. Clip 194 is a one-piece metal part comprising a flat, somewhat U-shaped fork 196 having tines 198. At the base of the U are two side-by-side curved bends 199 of about 180 degrees that extend from the base of the U to an apertured tongue 200 that is spaced from, but generally parallel with, fork 196. Tongue 200 terminates in a short, leading margin 201 that is canted away from fork 196.

Details of cup 60 that are related to clip 194 can be seen in various ones of FIGS. 17–25. Immediately proximate its rim, the circular wall 202 of the cup comprises through-slots 204 arranged for acceptance of tines 198. On the exterior of wall 202, half-way between the two through-slots 204 that are toward socket 76, there is a tab 206 that is disposed generally radial to the axis of cup 60. An edge of tab 206 is inclined to form a ramp 208 leading up to, and above, the cup's rim. The tab ends at the I.D. of the cup to present a radially inwardly facing shoulder 210.

Figure 39:
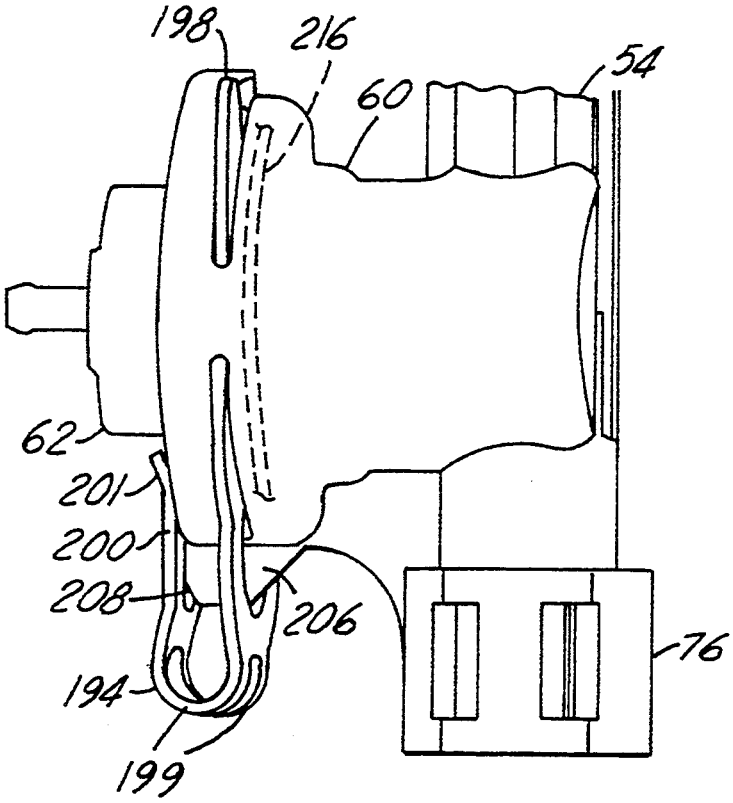
FIG. 39 is an enlarged fragmentary view of a portion of FIG. 1.

Installation of both fuel pressure regulator 62 and clip 194 are made as follows. The fuel pressure regulator is inserted into the cup to create a sealed annular zone 212 that communicates the pressurized fuel in tube passageways 52*a*, 54*a* to the fuel chamber of the pressure regulator. The return port of the pressure regulator is received in fluid-tight relation in a small well 214 that is at the bottom of the cup for conveying excess fuel to return tube 74. A circular flange 216 around the outside of the fuel pressure regulator body (FIG. 39) is disposed between a shoulder of the cup and through-slots 204. The free ends of tines 198 are aligned with the two through-slots that are to immediately opposite sides of tab 206, and the clip is moved bodily radially inwardly of the cup. The tines pass in overlying relation to flange 216, trapping pressure regulator 62 in cup 60 in the process. A point is reached where the leading margin 201 of the clip's tongue 200 contacts ramp 208. Continued movement of the clip causes leading margin 201 to ride up ramp 208, resiliently increasingly spreading the clip in the process since the fit of the tines in the through-slots is not sufficiently loose to allow the spreading to be avoided. Finally a point is reached where leading margin 201 of tongue 200 clears tab 206 to register the aperture of tongue 200 with the tab, and so the clip relaxes, causing the tab to lodge in the aperture. This creates an interference preventing extraction of the clip unless it is first expanded to clear the tab as it would be when it is intended to be removed.

Figure 40:
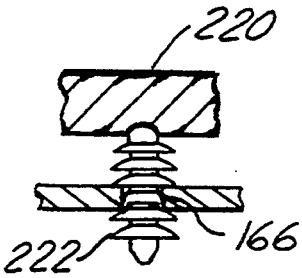
FIG. 40 is a fragmentary view of an additional feature.

FIG. 40 shows the usage of holes 166 for locating a wiring harness 20 that connects to the electrical connectors of the fuel injectors. The wiring harness comprises "Christmas-tree" connectors at various locations. These connectors are plastic and have corrugated shafts 222 that are nominally larger than holes 166. But the corrugated nature allows the individual corrugations to deflect upon insertion of the shaft into a hole 166, but to resist withdrawal, whereby the wiring harness can be located, and retained, simply by pushing the shafts into the holes. A metal bracket 224 is joined to the outside of tube 64 and its contains two holes 226, 228 that are also used for "Christmas-trees" of the wiring harness, one of the holes 226, 228 for a portion of the harness going to one plastic tube 52, 54, and the other for that portion of the harness going to the other plastic tube.

The purpose of holes 168 is to provide an alternate arrangement for fastening brackets 96, 96'. The brackets can be shaped with holes that align with holes 168, and screws can be run through the bracket holes and into holes 168. The drawings show other features including, various structural stiffeners (ribs, webs, etc.) integral with the fuel tubes 52, 54, and a socket 180 near the middle of tube 54 for receiving a fuel temperature sensor (not shown) that is inserted in a sealed manner to sense the temperature of fuel in that tube.

While a presently preferred embodiment of the invention has been illustrated and described, it should be appreciated that principles are applicable to other embodiments.

What is claimed is:

1. An internal combustion engine fuel rail assembly comprising a main fuel tube comprising multiple sockets at spaced apart locations along its length, fuel injectors inserted fluid-tight in certain of said sockets, a first component inserted fluid-tight in a first of said multiple sockets, a second component inserted fluid-tight in a second of said multiple sockets proximate said first socket, said first socket and said second socket each comprising a corresponding wall, and retainer means for retaining said first and second components fluid-tight in their respective sockets by preventing their extraction from their respective sockets, characterized in that one of said walls contains a corresponding through-opening, and said retainer means comprises a bracket having an intermediate portion and end portions at respective ends of said intermediate portion, one of said bracket end portions passes through said through-opening and into an interference relationship with the particular component inserted into the particular one of said first and second sockets whose wall contains said through-opening so as to prevent withdrawal of said particular component from said particular socket, the other of said bracket end portions assumes an interference relationship with said the other of said first and second components to prevent extraction of said second component from its socket, and fastening means for holding said intermediate portion of said bracket fast on said main fuel tube.

2. An internal combustion engine fuel rail assembly as set forth in claim 1 characterized further in that said fastening means comprises a hole in said intermediate portion of said bracket and a catch projecting from said main fuel tube through said hole to retentively engage said bracket.

3. An internal combustion engine fuel rail assembly as set forth in claim 2 characterized further in that said intermediate portion of said bracket, as viewed in plan, has an angled shape.

4. An internal combustion engine fuel rail assembly as set forth in claim 3 characterized further in that said intermediate portion of said bracket is substantially planar, and said bracket end portions depend from said substantially planar intermediate portion of said bracket.

5. An internal combustion engine fuel rail assembly as set forth in claim 4 characterized further in that said first component that is inserted fluid-tight into said first of said multiple sockets is a plug that closes an otherwise open end of said main fuel tube.

6. An internal combustion engine fuel rail assembly as set forth in claim 5 characterized further in that said second component that is inserted fluid- tight into said second of said multiple sockets is an end of a further tube that is in fluid communication with said main fuel tube.

7. An internal combustion engine fuel rail assembly as set forth in claim 4 characterized further in that said second component that is inserted fluid- tight into said second of said multiple sockets is an end of a further tube that is in fluid communication with said main fuel tube.

8. An internal combustion engine fuel rail assembly as set forth in claim 1 characterized further in that said first component that is inserted fluid-tight into said first of said multiple sockets is a plug that closes an otherwise open end of said main fuel tube, and said second component that is inserted fluid- tight into said second of said multiple sockets is an end of a further tube that is in fluid communication with said main fuel tube.

9. An internal combustion engine fuel rail assembly as set forth in claim 8 characterized further in that said fastening means comprises a hole in said intermediate portion of said bracket and a catch projecting from said main fuel tube through said hole to retentively engage said bracket.

10. An internal combustion engine fuel rail assembly as set forth in claim 8 characterized further in that the bracket end portion that prevents extraction of said plug from said first socket is a flat blade, and the bracket end portion that prevents extraction of said further tube from said second socket is a flat forked blade.

11. An internal combustion engine fuel rail assembly as set forth in claim 1 characterized further in that the other of said walls contains a respective through-opening, and said other of said bracket end portions passes through said through-opening of said other of said walls to assume the interference relationship with said other of said first and second components.

* * * * *